US012408713B2

(12) United States Patent
Flatt et al.

(10) Patent No.: US 12,408,713 B2
(45) Date of Patent: Sep. 9, 2025

(54) SWEAT DIVERTING TEXTILE WITH INTEGRATED GUTTER

(71) Applicant: GUTR, Inc., Dallas, TX (US)

(72) Inventors: Erick Flatt, Dallas, TX (US); Kevin Flatt, Wilmette, IL (US)

(73) Assignee: GUTR, Inc., Dallas, TX (US)

( * ) Notice: Subject to any disclaimer, the term of this patent is extended or adjusted under 35 U.S.C. 154(b) by 0 days.

(21) Appl. No.: 18/219,496

(22) Filed: Jul. 7, 2023

(65) Prior Publication Data

US 2025/0009061 A1 Jan. 9, 2025

(51) Int. Cl.
*A41D 20/00* (2006.01)

(52) U.S. Cl.
CPC ..... *A41D 20/00* (2013.01)

(58) Field of Classification Search
CPC ..... A41D 20/00
See application file for complete search history.

(56) References Cited

U.S. PATENT DOCUMENTS

| | | | | |
|---|---|---|---|---|
| 5,073,989 | A | 12/1991 | Teague | |
| 5,590,422 | A | 1/1997 | Henderson | |
| 5,901,381 | A | 5/1999 | Nelson | |
| 5,926,849 | A | 7/1999 | Boyle | |
| 6,353,936 | B2 | 3/2002 | Flatt | |
| 7,398,559 | B2 | 7/2008 | Flatt | |
| 9,009,869 | B1 | 4/2015 | Shapiro et al. | |
| D793,674 | S | 8/2017 | Flatt | |
| 10,076,150 | B1 | 9/2018 | Flatt | |
| 10,517,339 | B1 * | 12/2019 | Baxter | A41D 20/00 |
| 2015/0208742 | A1 * | 7/2015 | Shapiro | A41D 20/00 2/171 |

FOREIGN PATENT DOCUMENTS

| | | | |
|---|---|---|---|
| DE | 678820 | C | 7/1939 |
| KR | 200462551 | Y1 | 9/2012 |

OTHER PUBLICATIONS

International Search Report & Written Opinion from related PCT Application PCT/US2024/35987 dated Oct. 16, 2024, 9 pages.

* cited by examiner

*Primary Examiner* — Jocelyn Bravo
(74) *Attorney, Agent, or Firm* — Braxton Perrone, PLLC; Gregory Perrone; Bobby W. Braxton

(57) ABSTRACT

A sweat diverting gutter integrated into headwear for removing perspiration that escapes the material including a substantially u-shaped gutter formed from upper and lower gutter portions connected by at least one connecting post and a corresponding post receptacle between the gutter parts. The placement of the diverting gutter on the exterior side of the headwear causes excess sweat to be laterally moved from on or around the wearer's forehead away from the eyes and face.

18 Claims, 12 Drawing Sheets

SWEAT DIVERTING TEXTILE WITH INTEGRATED GUTTER

FIELD OF THE INVENTION

The present invention relates to headwear, and in particular a sweat diverting textile having an integrated sweat diverting gutter for removal of sweat from the eye area of a wearer.

BACKGROUND

Since the beginning of man, humans sweat when working, playing or even sometimes when at rest. The phenomenon of sweat pouring off a person's head, while providing relief in terms of the body naturally cooling itself, is particularly unappealing when sweat gets into one's eyes. For someone who wears eyeglasses or sunglasses, the problem is worse, as glasses fog up and get wet, impairing the vision of the wearer.

Often times, the person sweating is wearing a hat. This could occur by an athlete, such as a baseball player who wears a cap as part of a uniform, or a golfer wearing a hat for protection from the sun. Similarly, those exercising at a gym or at home, or runners, may wear a hat or some other form of headgear, to keeping the head warm in cold climates, or just as a matter of style.

Workers also wear hats. Laborers wear hats in hot weather as protection from the sun and in cold weather for warmth. Even in cold weather, people sweat when exerting themselves. Regardless of the reason a person might wear a hat during sport, work or leisure, the fact remains that all are prone to sweating. The perspiration from a forehead, for example, often soaks into the hat (e.g., baseball cap, visor or beanie) stains the hat or flows into the user's eyes. An old attempt to resolve the problem is wearing absorbent sweatband underneath the hat. The problem with sweatbands, however, is that they have a saturation point and eventually become ineffective in keeping sweat out of the eyes in addition to being cumbersome to wear along with a hat.

After a headband becomes saturated, the user must remove the headband and replace, or wring it out, it or excess perspiration will flow out from the saturated headband thereby rendering it ineffective.

A prior need for a headband that prevents sweat from getting in one's eyes, even after a long period of time when conventional headbands would be saturated and dripping perspiration into one's eyes. Patents naming the inventor in the present application have issued, with these patents directed towards a sweat diverter device that is attached it to the interior (head facing side) of a hat, such as a baseball cap. Tabs and connectors are utilized, enabling attachment of the diverter device by the user or reseller of the hat to attach the diverter to the hat. Some of the issues associated with these prior devices include the inconvenience and difficulty encountered in affixing the diverter device to a hat that as sold is not equipped to receive the diverter. Also, since the diverter device was not integrated into the material or fabric of the hat, with excessive sweat the diverter device may have not been fully effective in keeping perspiration away from the wearer's eyes. This was due to an often imperfect interface between the diverter device and the interior surface of the hat. Such imperfections allowed liquid to seep or spill behind the diverter and drip into the wearer's eyes.

The diverter device presently disclosed alleviates the shortcomings of the prior art in that the diverter device is integrated into a textile, enabling a headwear manufacturer to integrate the device into the headwear without the need to rely on hook, tabs, connector devices or the like. The presently described sweat diverting textile provides seamless efficiency, with diverting sweat even when the hat absorbs a large volume of sweat.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
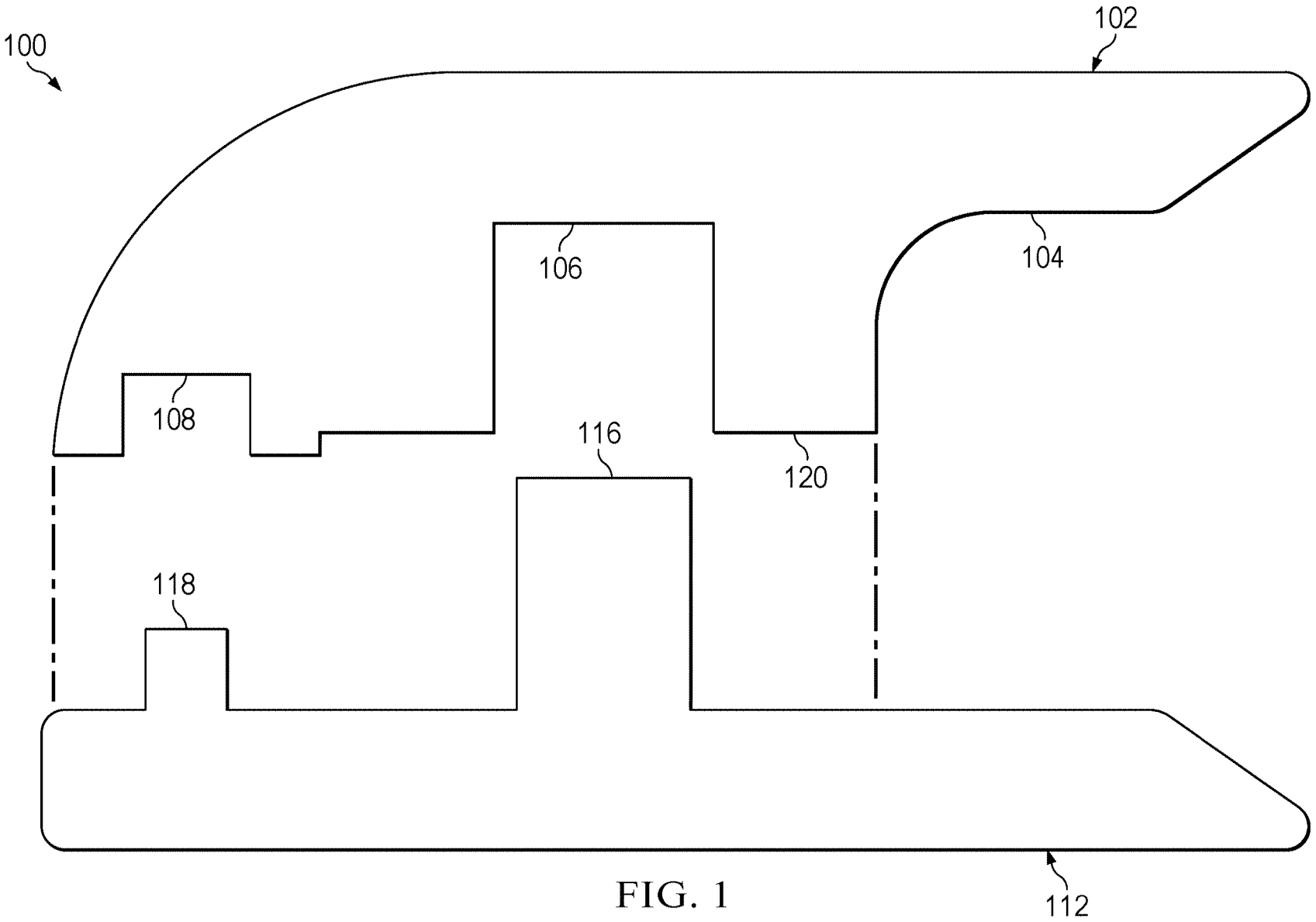
FIG. 1 is a cross sectional view of components of a sweat diverter gutter according to an embodiment.

While the system and method of the present application are susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE EMBODIMENTS

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The system and method will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The embodiment herein described is not intended to be exhaustive or to limit the invention to the precise form disclosed. It is chosen and described to explain the principles of the invention and its application and practical use to enable others skilled in the art to follow its teachings.

The presently described sweat diverting textile will now be described in detail according to the accompanying figures.

FIG. 1 is a cross sectional view of components of a sweat diverter gutter according to an embodiment. In FIG. 1, sweat diverter gutter 100 is depicted. Sweat diverter gutter 100 as shown in comprised of two main parts. Upper gutter section 102 is comprised of a main body section 104, which is curved and by itself on one embodiment forms a narrow c-shape. Lower gutter section 112 is an elongated member. As shown, lower gutter section 112 includes at one end at least one post 116 and at least one spine 118. Upper gutter section 102 includes at least one post receptacle 106 for receiving a corresponding at least one post of lower gutter section 112. Upper gutter section 102 also comprises spine recess 108 for receipt of corresponding spine 118 of lower gutter section 112. Upper gutter section 102 also includes lower face 120 that abuts lower gutter section 112 when upper and lower gutter sections 102 and 112 are joined.

As will be shown in subsequent figures, upper gutter section 102 and lower gutter section 112 are constructed to mate via the corresponding post and post receptacle for each piece, as described. It is contemplated that for secure connection of upper gutter section 102 and lower gutter section 112, multiple posts 116 and corresponding post receptacles 106 are disposed along the respective gutter sections. In one embodiment, as many as nine such post and post receptacle pairs span the length of sweat diverter gutter 100, with spine 118 and corresponding spine recess 108 spanning substantially the entire length of sweat diverter gutter 100, as will be shown in FIG. 2. As shown in FIG. 1, when upper gutter section 102 and lower gutter section 112 are joined, the parts have a u-shaped cross section, which forms a gutter or diverting sweat from the user's forehead, as will be discussed.

Figure 2:
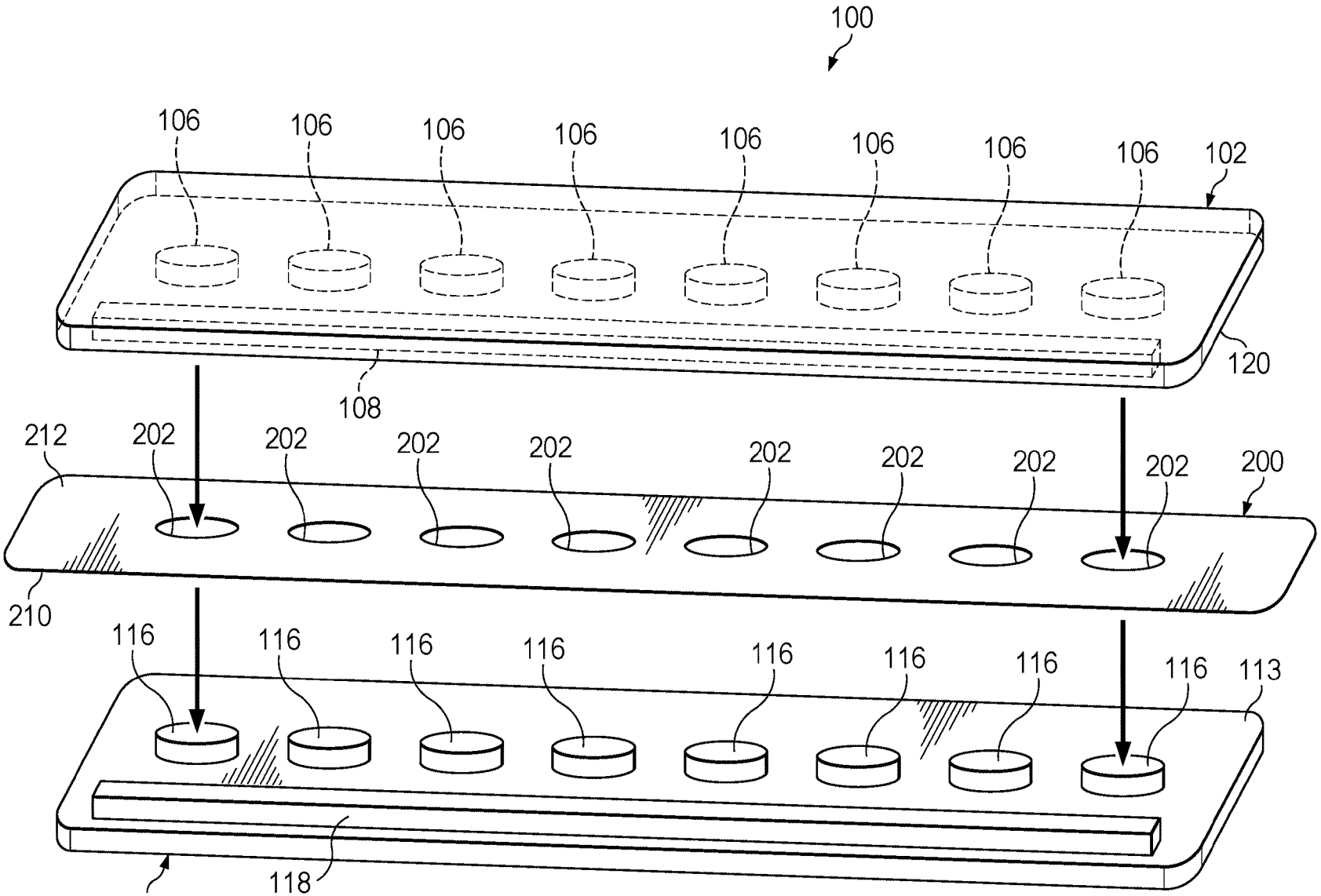
FIG. 2 is a component diagram of a sweat diverter gutter according to an embodiment.

FIG. 2 is a component diagram of a sweat diverter gutter according to an embodiment. In FIG. 2, sweat diverter gutter 100 is shown in perspective view with its upper gutter section 102 and lower gutter section 112 shown unassembled. As shown, in one embodiment upper gutter section 102 comprises a plurality of post receptacles 106 arranged along the length of upper gutter section 102. In another embodiment, there is one or more post receptacles 106 in upper gutter section 102. Optionally, spine recess 108 also spans the length of upper gutter section 102. Continuing, lower gutter section 112 comprises a plurality of posts 116 arranged for receipt by a corresponding plurality of post receptacles 106 on upper gutter section 102. In another embodiment, lower gutter section 112 comprises one or more posts 116 for receipt by a corresponding one or more post receptacles 106 on upper gutter section 102. Lower gutter section 112 also comprises spine 118 for insertion into spine recess 108 on upper gutter section 102. When installed, posts 116 and spine 118 are aligned with the corresponding post receptacles 106 and spine recess 108 of upper gutter section 102. In the embodiments discussed herein, at least one post 116 and corresponding post receptacle 106 are utilized to join upper gutter section 102 and lower gutter section 112, with or without spine 118 and corresponding spine recess 108.

In one embodiment, before the two gutter sections are mated, reinforcement scrim 200 is inserted between upper gutter section 102 and lower gutter section 112, reinforcement scrim 200 is sized according to the length of upper and lower gutter sections. In one embodiment, lower gutter section 112 is longer than upper gutter section 102. Reinforcement scrim 200 is longer than lower gutter section 112 and in one embodiment is three times the length of upper gutter section 102. This excess length of scrim 200 enables secure integration of sweat diverter gutter 100 into the headwear, as will be discussed. In another embodiment, a reinforcement scrim is not placed between upper gutter section 102 and lower gutter section 112, with the two gutter sections bonded together directly.

Within reinforcement scrim 200 are a series of apertures 202. Apertures 202 are sized to receive posts 116 of lower gutter section 112 as posts 116 are inserted into corresponding post receptacles 106 of upper gutter section 102. The elongated ends 210 and 212 of reinforcement scrim 200 enable secure fastening of sweat diverter gutter 100 to the desired headwear, as will be described. The arrows within FIG. 2 indicate how lower gutter section 112 receives reinforcement scrim 200 and upper gutter section 102, thus sandwiching reinforcement scrim 200 between the upper gutter section and lower gutter section. Posts 116 and post receptacles 106 are precisely sized in order for the closer or connection of upper gutter section 102 and lower gutter section 112 to be snug, with reinforcement scrim 200 tightly fit in between.

In one embodiment, these separate gutter sections are detached and form a two-piece gutter once joined by the posts and spine. In an alternative embodiment, upper gutter section 102 and lower gutter section 112 are connected via a hinge. The hinge is placed along the length of each gutter section. The hinge permits opening and closing of the gutter sections during the bonding and gluing process described below and for placement of the reinforcement scrim, if applicable. With the hinged gutter sections, the two gutter halves are similarly connected via the posts and the spine.

Figure 3:
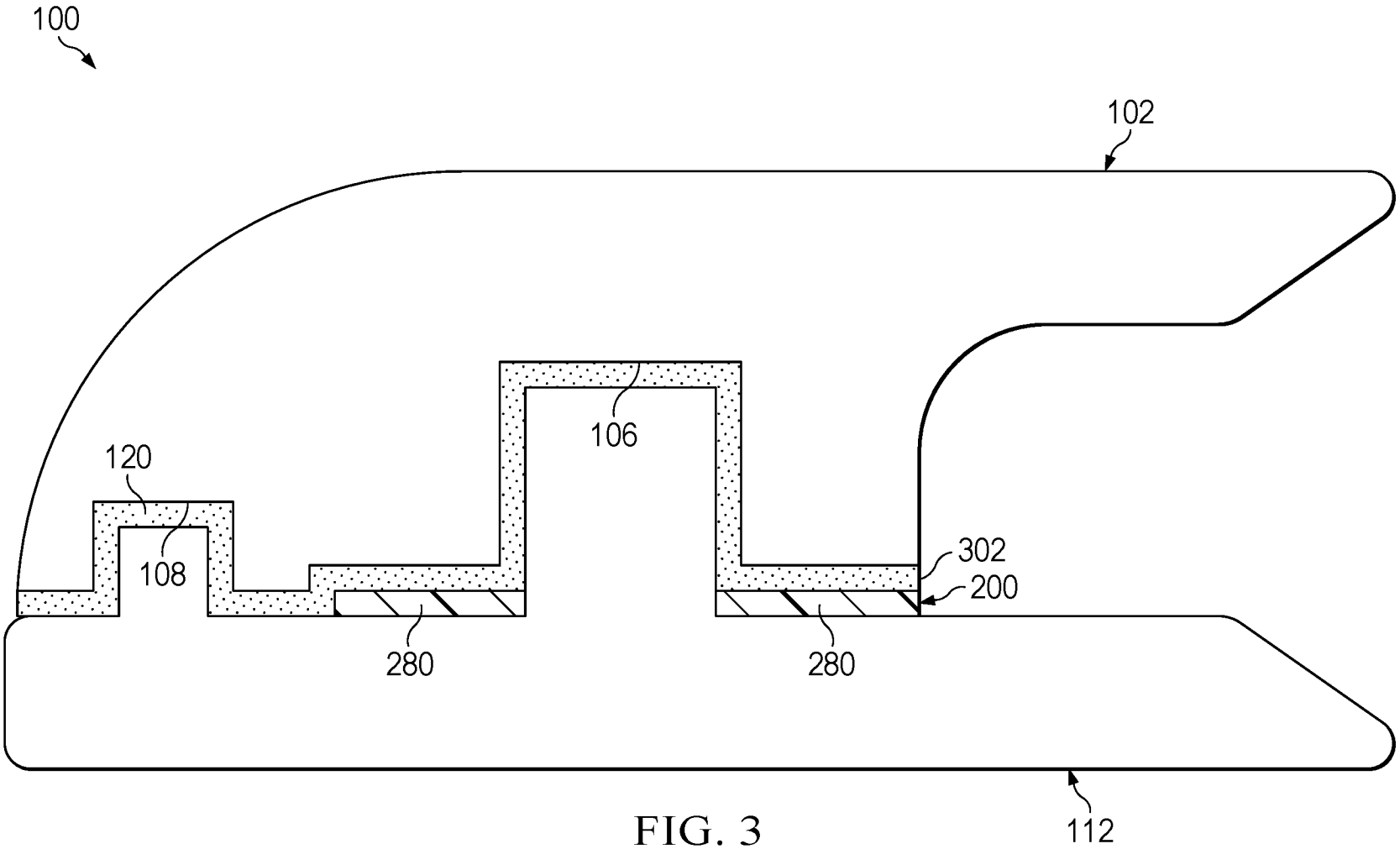
FIG. 3 is a cross sectional view of connected components of a sweat diverter gutter according to an embodiment.

FIG. 3 is a cross sectional view of connected components of a sweat diverter gutter according to an embodiment. In FIG. 3, upper gutter section 102 and lower gutter section 112 are connected with reinforcement scrim 200 in between the sections. To adhere upper lower gutter section 102 to scrim 200 and lower gutter section 112, a thin film 280 is applied to the upper face of lower gutter section 112, around posts 116 corresponding to the footprint of reinforcement scrim 200. Once thin film 280 is placed, reinforcement scrim is placed on lower gutter section 112, with each of posts 116 passing through the corresponding aperture 202 of scrim 200. This sets reinforcement scrim 200 in place on lower gutter section 112. In one embodiment thin film 280 is an adhesive in tape form for preventing sliding of reinforcement scrim 200 on lower gutter section 112.

Continuing with FIG. 3, in one embodiment a glue layer 302 is applied to lower face 120 of upper gutter section 102. This glue layer 302 in one embodiment is a liquid adhesive, although other adhesives are suitable. Glue layer 302 extends the width and length of upper gutter section 102 and lines post receptacle 106 and spine recess 108. Once glue layer 302 is in place, posts 116 are inserted into corresponding apertures 202 of scrim 200 and inserted into corresponding post receptacles 106 of upper gutter section 102. When pressed together, glue layer 302 forms a bond that keeps the upper gutter, lower gutter and scrim "sandwiched" together.

Alternatively, other forms of bonding upper gutter section 102 and lower gutter section 112 (with or without scrim 200 in between) are employed, such as heat bonding or other appropriate bonding or adhesive substances or methods.

Figure 4:
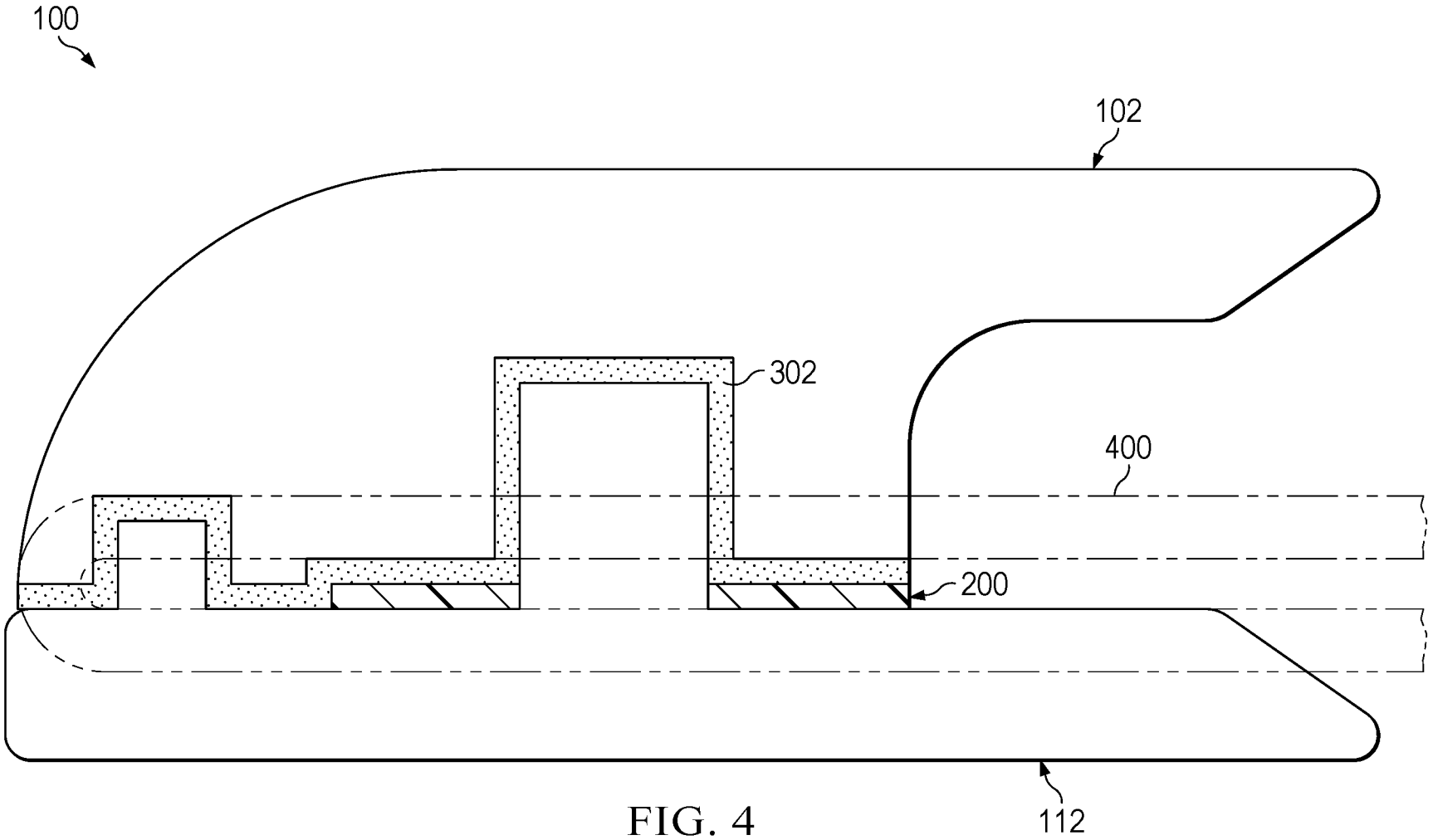
FIG. 4 is a cross sectional view of integrated components of a sweat diverter gutter according to an embodiment.

FIG. 4 is a cross sectional view of integrated components of a sweat diverter gutter according to an embodiment. In FIG. 4, assembled sweat diverter gutter 100 is shown as described in FIG. 3. FIG. 4, however, depicts integration of sweat diverter gutter 100 into fabric 400. Fabric 400 is fabric that is used for a piece of headgear of interest, such as the front of a baseball cap, a beanie or a headband. As shown in detail in the next figures, assembled sweat diverter gutter 100 is inserted within the assembled garment, in this case a headband, with a lower portion of the headband folded over sweat diverter gutter 100, which occupies an opening of the headband. The provides secure placement of sweat diverter gutter 100 within the headband and permitting exposure of the upper gutter section 102, which acts as the collector of sweat, as will be described.

Figure 5:
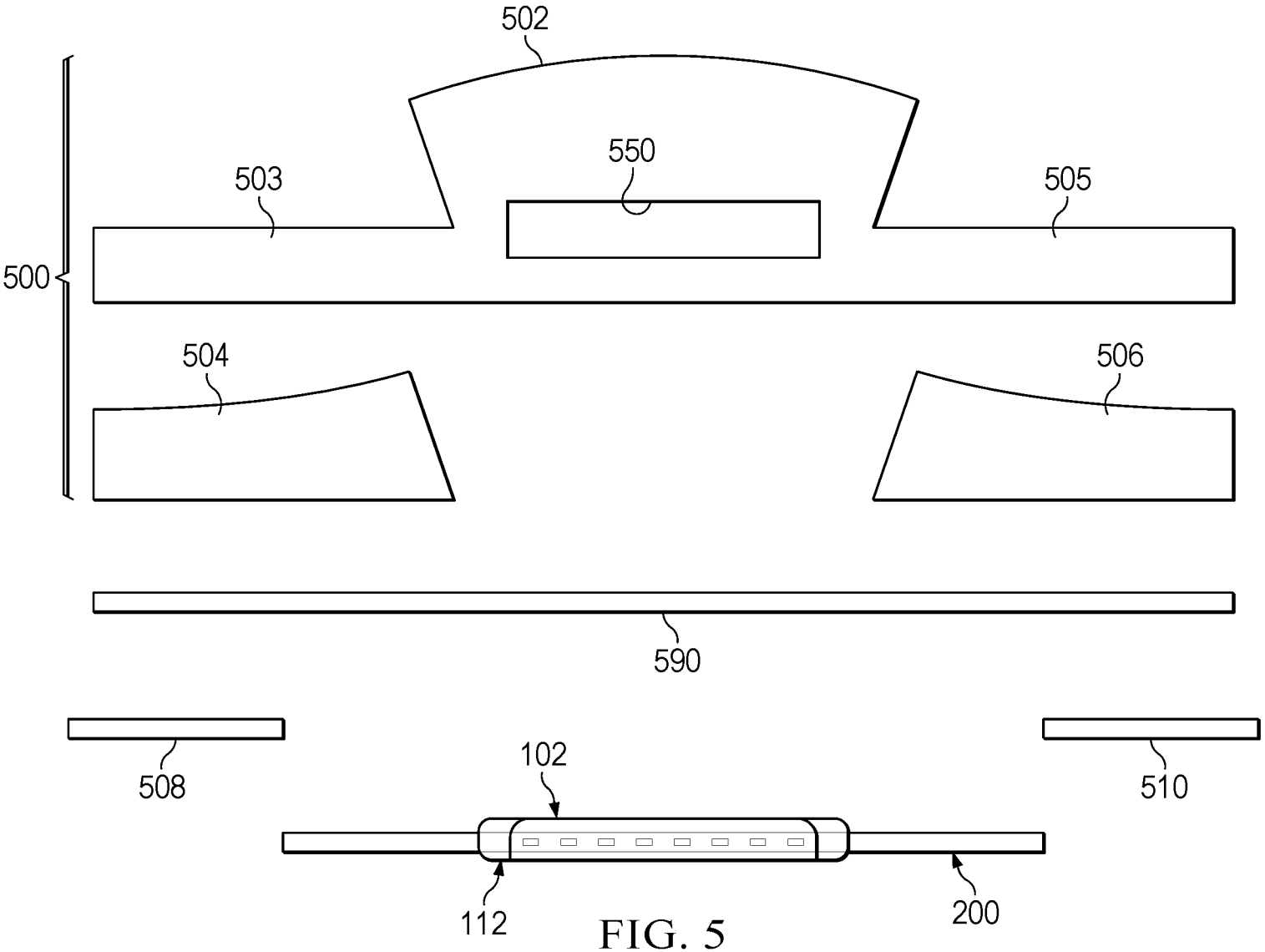
FIG. 5 is a plain view of components of a headband in which a sweat diverter gutter will be integrated according to an embodiment.

FIG. 5 is a plain view of components of a headband in which a sweat diverter gutter will be integrated according to an embodiment. In FIG. 5 typical components of a headband 500 are shown. Headband 500 includes headband body section 502 and left side section 504 and right side section 506. Body section 502 and side panels 504 and 506 in one embodiment are made of the same material but in another embodiment they are made of different materials. With one of the materials advantageously being more absorbent while another is stretchable. Headband body section 502 includes window 550. Window 550 is disposed between left strap 503 and right strap 505. Window 505 is also positioned with a sufficiently wide band of body section material below it to later permit folding this excess band over sweat diverting gutter 100, as will be described.

Left extender 508 and right extender 510 are also shown. Left extender 508 and right extender 510 will be fixed to a corresponding end of reinforcement scrim 200, each of which extends beyond upper gutter section 102 and lower gutter section 112. Left extender 508 and right extender 510 serve to secure sweat diverter gutter 100 within headband 500, as will be described. Left extender 508 and right extender 510 are bar tacked or fastened by other means to the ends of reinforcement scrim 200, which is sandwiched between and adhered to upper gutter section 102 and lower gutter section 112, as discussed above.

Figure 6:
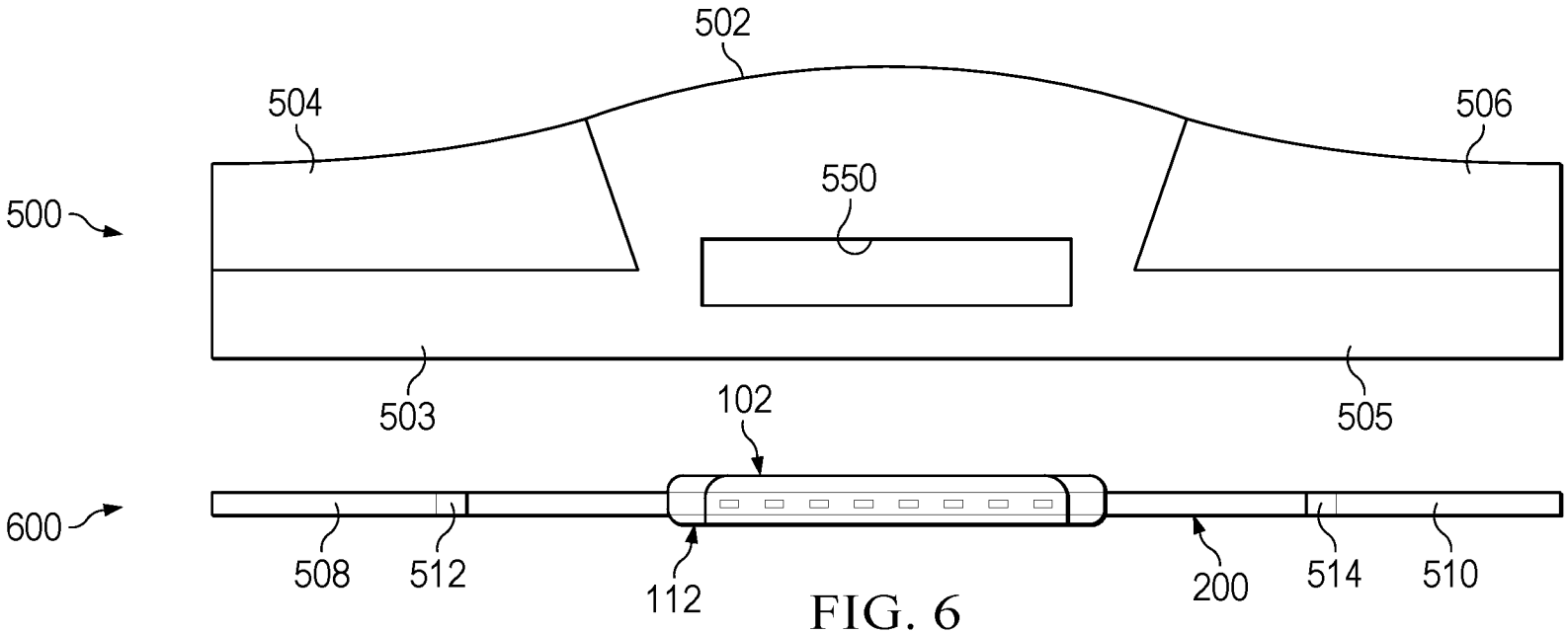
FIG. 6 is a plain view of components of a headband in which a sweat diverter gutter will be integrated according to an embodiment.

FIG. 6 is a plain view of components of a headband in which a sweat diverter gutter will be integrated according to an embodiment. In FIG. 6, various components of headband 500 discussed in FIG. 5 are assembled. Left side panel 504 and right side panel 506 are placed in corresponding openings of headband body section 502. Left side panel 504 and right side panel 506 are secured to body section 502 by stitching, adhesive or the like. Also as shown in FIG. 6, left extender 508 is bar tacked at left connection point 512 to the left side of reinforcement scrim 200 and right extender 510 is bar tacked at right connection point 514 to the right side of reinforcement scrim 200. This effectively serves to extend the length of reinforcement scrim 200 and the entire subassembly of upper gutter section 102 and lower gutter section 112 and reinforcement scrim 200 to match the width of the lower edge of headband 500. Gutter subassembly 600 is a substrate that now can be securely integrated into the fabric of headband 500, as discussed in the next figures.

Figure 7:
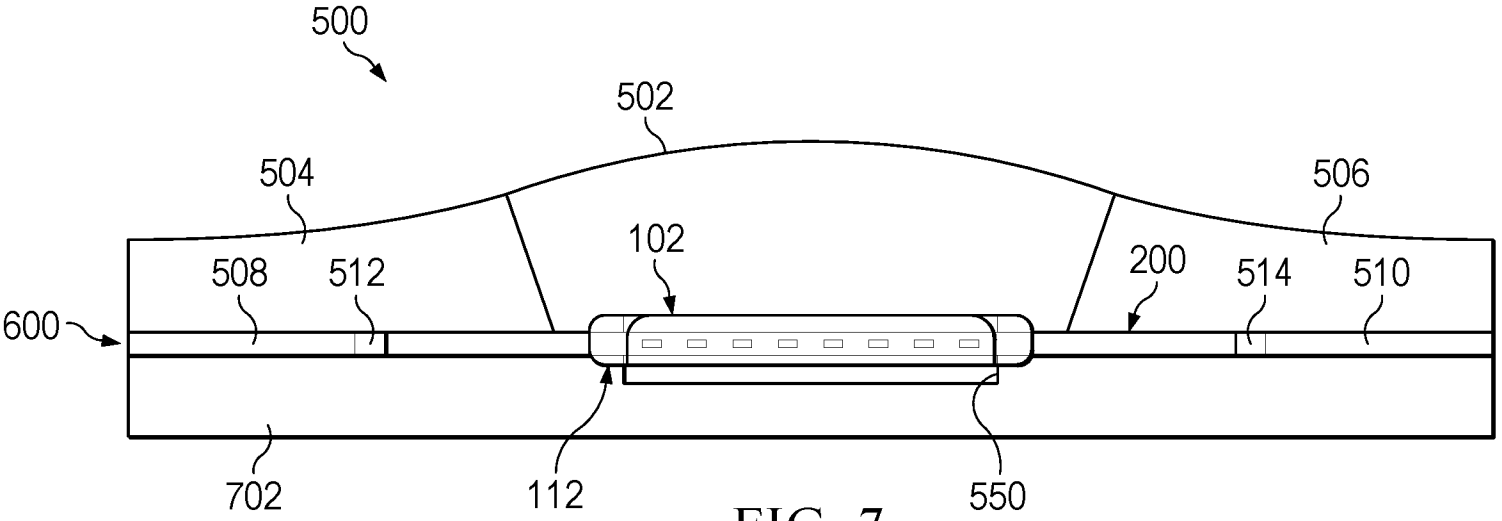
FIG. 7 is a plain view of components of a headband in which a sweat diverter gutter will be integrated according to an embodiment.

FIG. 7 is a plain view of components of a headband in which a sweat diverter gutter will be integrated according to an embodiment. In FIG. 7, gutter subassembly 600 is positioned within window 550. Note gutter subassembly 600 may be disposed anywhere vertically on the fabric and the placement in FIG. 7 is only exemplary. Depending on the fabric and the type of headwear, gutter subassembly may be disposed higher towards the center of the fabric or lower towards the lower edge of the fabric, with window 550 positioned accordingly. In FIG. 7, the exterior side of headband 500 is shown. That is, the side of headband 500 that others see. This is known as "the world side". Gutter subassembly 600 is positioned with the upper gutter section 102, lower gutter section 112, with the apertured section of reinforcement scrim 200 within window 550. The extended ends of reinforcement scrim 200 with bar tacked left extender 508 and right extended 510 span across the width of the lower end of assembled body section 502 and left side panel 504 and right side panel 506. In this position, gutter subassembly 600 is placed for final integration into headband 500 with fabric lower section 702 comprising the fabric that extends laterally from one side of headband 500 to the other and beneath gutter assembly 600. Note in FIG. 7, a slice of window 550 beneath upper gutter section 102 and lower gutter section 112 is exposed. That is, this slice of window 550 is vacant. This permits clean folding of fabric lower section 702 over gutter subassembly as described in the next figure.

The assembly process and structure described above entails placement of reinforcement scrim 200 between upper gutter section 102 and lower gutter section 112 before attaching scrim 200 to the fabric of the headband. In another embodiment, reinforcement scrim 200 is attached to extensions 508 and 510 before insertion of scrim 200 between the two gutter sections.

The operation of the presently described sweater diverter gutter is not conditioned upon the absorbency of the material into which it is integrated. Headwear made of less absorbent, minimally absorbent, or non-absorbent material are appropriate and effective platforms for the diverter gutter, acting as a carrying system to direct flow of sweat into the gutter, which in turn runs away from the user's eyes.

Figure 8:
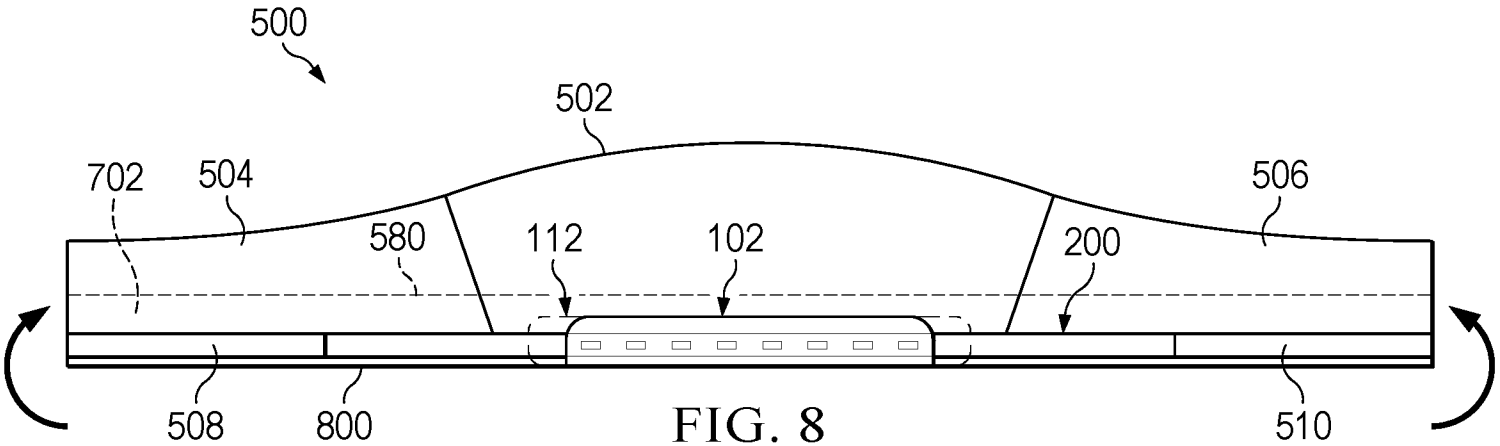
FIG. 8 is a plain view of components of a headband in which a sweat diverter gutter is integrated according to an embodiment.

FIG. 8 is a plain view of components of a headband in which a sweat diverter gutter is integrated according to an embodiment. FIG. 8 is a continuation of the assembly process of FIG. 7. In FIG. 8, fabric lower section 702 is folded up and over the left extender 508, reinforcement scrim 200, assembled upper gutter section 102 and lower gutter section 112 and right extender 510. Fabric lower section 702 is folded over gutter assembly 600 in a manner that leaves the lower edge of upper gutter section 102 and lower gutter section 112 coextensive with the bottom edge 800 of headband 500. Note that once fabric lower section 702 is folded upward (in the direction of arrows), from the exterior view (the view of others), upper gutter section 102 appears, and lower gutter section 112 is obscured, as is the extent of reinforcement scrim 200 on which no posts 106 reside (as shown in dashed lines). Once folded, seam 580 runs the length of headband 580, and above window 550. Lower fabric section 702 is bonded to the main fabric portion of headband 500 comprised of left side panel 504, right side panel 506 and headband body section 502 by adhesive or heat sealing other techniques known in the art. In one embodiment, the cut fabric pattern may remain flat when gutter subassembly 600 in integrated into the fabric, as described above. In another embodiment, however, the fabric is folded once or several times, depending on the nature of the headwear, and then gutter subassembly 600 is integrated therein.

Figure 9:
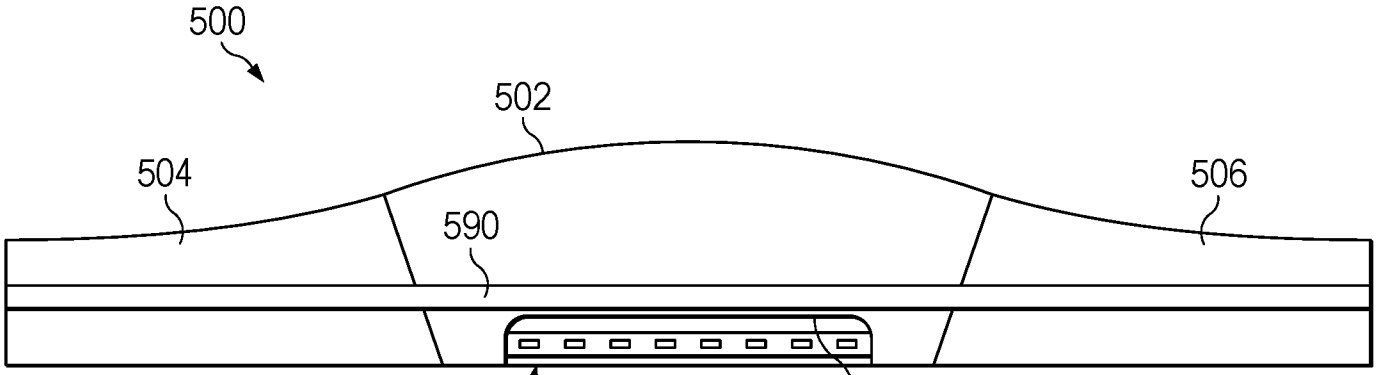
FIG. 9 is an exterior view of a headband in which a sweat diverter gutter is integrated according to an embodiment.

FIG. 9 is an exterior view of a headband in which a sweat diverter gutter is integrated according to an embodiment. FIG. 9 continues the process of integrating sweat diverter gutter 100 into headband 500. Recall in FIG. 8, fabric lower section 702 was folded upward and over gutter subassembly 600, with seam 580 running the length of headband 580, and above window 550. Now in FIG. 9, seam 580 is closed or covered in one embodiment by stitching seam 580 onto the main fabric portion of headband 500 comprised of left side panel 504, right side panel 506 and headband body section 502. In another embodiment, an adhesive tape strip 590 is applied to cover the seam and close the union of lower fabric section 702 and the main headband body at seam 580. Tape strip 590 in one embodiment extends the length of headband 500, covering the entirety of seam 580. In FIG. 9, from the world side, only upper gutter portion 102 is visible through window 550.

Figure 10:
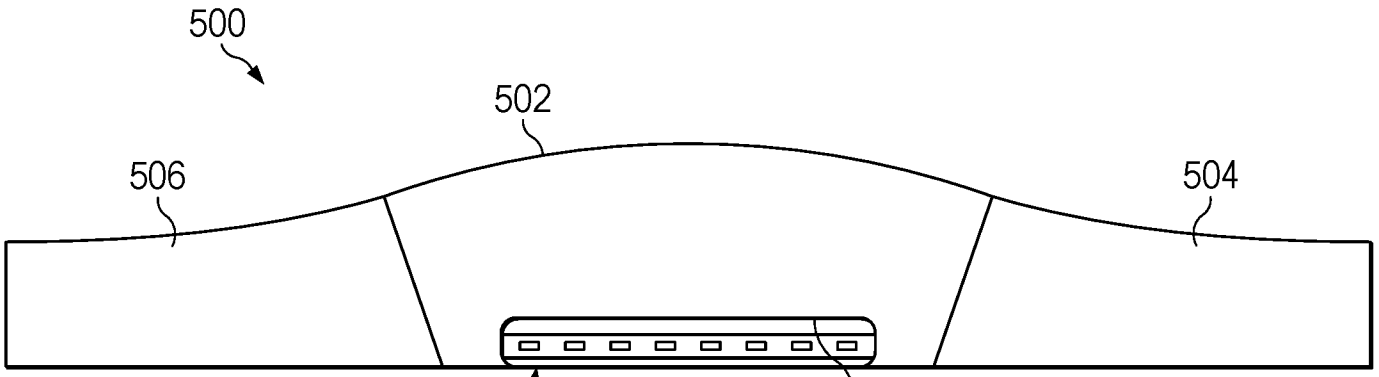
FIG. 10 is an interior view of a headband in which a sweat diverter gutter is integrated according to an embodiment.

FIG. 10 is an interior view of a headband in which a sweat diverter gutter is integrated according to an embodiment. This interior view of headband 500 is shown after the final assembly process described in FIG. 9. This interior view is known as "the skin side" because the interior side of sweat diverter gutter 100, abuts the headband wearer's skin. In FIG. 10, only lower gutter section 112 is visible through window 550.

As shown in FIG. 3, the assembled upper and lower gutter sections 102 and 112 form a u-shaped trough or gutter that collects liquid. In use, when a user wears headband 500 equipped with an integrated sweat diverter gutter assembly as described, the gutter extends laterally on the wearer's forehead. The gutter section is exposed through the opening or window as described. As the user sweats and the fabric of the headband becomes saturated, the excess sweat will leave the fabric on the exterior side of the headband. Once it does, the excess sweat is caught by u-shaped gutter and will flow to either end of the gutter subassembly. In this manner, instead of the user's sweat escaping the material of the headband and simply running down the user's forehead and ultimately into the user's eyes, the liquid will be directed to the sides and will eventually make its way out of the gutter at the sides of the user's face, away from the eyes. The presently described sweat diverter gutter provides a simply and effective means to keep sweat out of a person's eyes and face, eliminating burning of the eyes, foggy eyeglasses and the like.

There are various sub-techniques that are used in the manufacturing and assembly process of the presently described sweat diverter gutter and its integration. In one embodiment for the various headband component pieces shown in FIG. 5, headband body section 502 is comprised of double-knit jersey material, laser cut with the edges of the section cauterized. The side panel section 504 and 506 in one embodiment are a breathable knit mesh, also laser cut with edges cauterized. Tape strip 590 in one embodiment is a custom tape applique. Left side extender 508 and right side extender 510 in an embodiment are narrow woven elastic bands, that can withstand the user's pulling and stretching of the extenders when putting the headband on and taking it off.

Upper gutter section 102 and lower gutter section 112 of sweat diverter gutter 100 are manufactured from silicone, thermoplastic elastomer (TPE), fluorine rubber or the like. Reinforcement scrim 200 in an embodiment is constructed from commercially available scrims such as Vectran, which is a manufactured fiber spun from a liquid-crystal polymer.

The previous figures depict integration of the presently described sweat diverter gutter into fabric cut into patterned pieces that form a headband. Integration of the presently described diverter gutter into other forms of headwear such as caps, beanies, do-rags, and the like are also contemplated. Furthermore, integration into protective headwear such as construction helmets and bicycle helmets is also contemplated. Protective headwear of this time typically includes a liner or padded device for secure placement of the helmet on the wearer's head. In another embodiment, placement of gutter subassembly 600 as described herein into the front section of the helmet liner is described. Typically, helmet liners are more rigid or thicker than fabric garments such as headbands. As such, the liner device itself provides sufficient rigidity to support gutter assembly 600, with or without the sandwiching of a reinforcement scrim between gutter sections. In one embodiment, the assembled upper and lower gutter sections are bonded to the front section of the helmet liner or pad to divert accumulated sweat away from the user's eyes, as with the gutter integrated into the fabric. Helmet pads and liners are made in many shapes, sizes and thicknesses. Similar to the embodiments described, in an embodiment a helmet pad, liner or insert is patterned in similar fashion as the headband. An opening or window is formed in the body of the liner or pad section that will be associated with the front of the user's head, at or above the forehead. The gutter subassembly, with or without the reinforcement scrim, includes extensions that provide means to adhere gutter subassembly to the helmet pad.

Figure 12A:
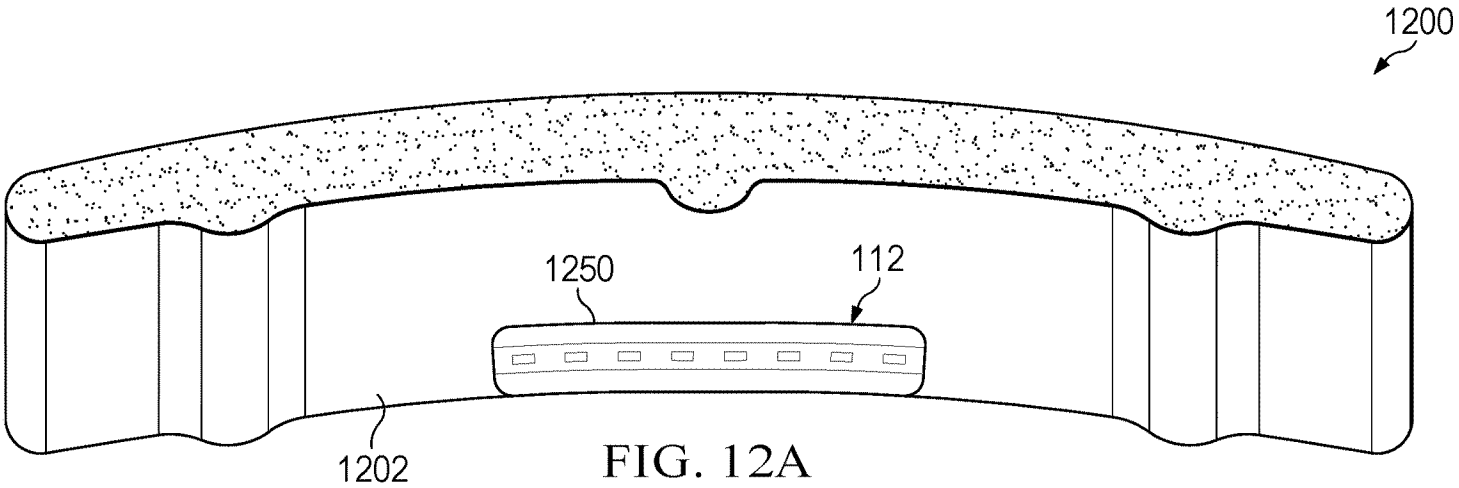
FIG. 12A and 12B are perspective views of a helmet protective pad in which a sweat diverter gutter is integrated according to an embodiment.
Figure 12B:
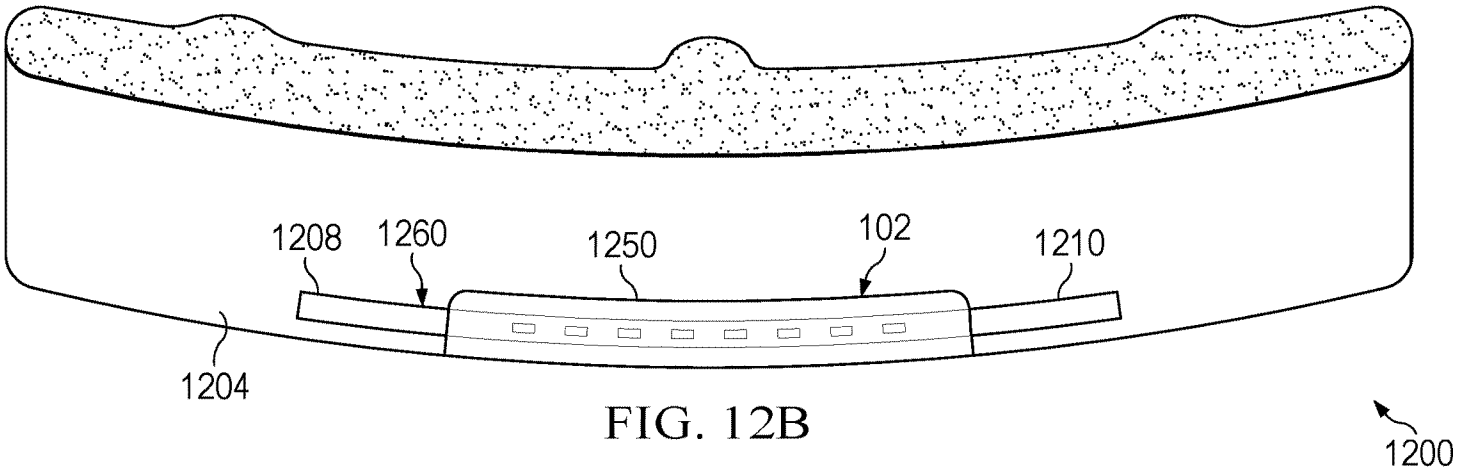

FIGS. 12A and 12B are perspective views of an embodiment of a protective helmet pad in which a gutter assembly is integrated. In FIG. 12A, helmet pad 1200 is depicted from the interior and in FIG. 12B helmet pad 1200 is depicted from the exterior. This type of helmet pad is sometimes found in a construction safety helmet. Helmet pad is generally of a curved or concave shape to conform to the user's head. Pad 1200 includes interior pad side 1202 that would contact the wearer's forehead. As shown, window 1250 is cut from interior pad side 1202, with window 1250 passing through the thickness of pad 1200 to the exterior pad side 1204. As shown, gutter subassembly 1260, which comprises lower gutter assembly 112 (shown in interior view), upper gutter assembly 102, left extension 1208 and right extension 1210 (shown in exterior view) is fastened to exterior pad side 1204 by fastening left extension 1208 and right extension 1210 to exterior pad side, with upper gutter section 102, or the "world side" facing away from the user's head. Lower gutter section 112 is shown on the interior pad side 1202 of helmet pad 1200 and is directed towards the user's forehead and is the "skin side" of the presently described sweat diverter gutter. Thus, as helmet pad 1200 is saturated with sweat, sweat is collected by the substantially u-shaped gutter formed by upper gutter section 102 and lower gutter section 112. In similar fashion as described with respect to previous embodiments, the gutter redirects or diverts sweat to the sides or the users face or head, keeping sweat out of the user's eyes.

Window 1250 in helmet pad and gutter subassembly 1260 as shown are disposed close to the lower edge of sports helmet pad 1200. This is but one embodiment and window 1250 and gutter assembly 1260 in other embodiments are situated at different positions vertically (away from the lower edge) along the pad.

Figure 13A:
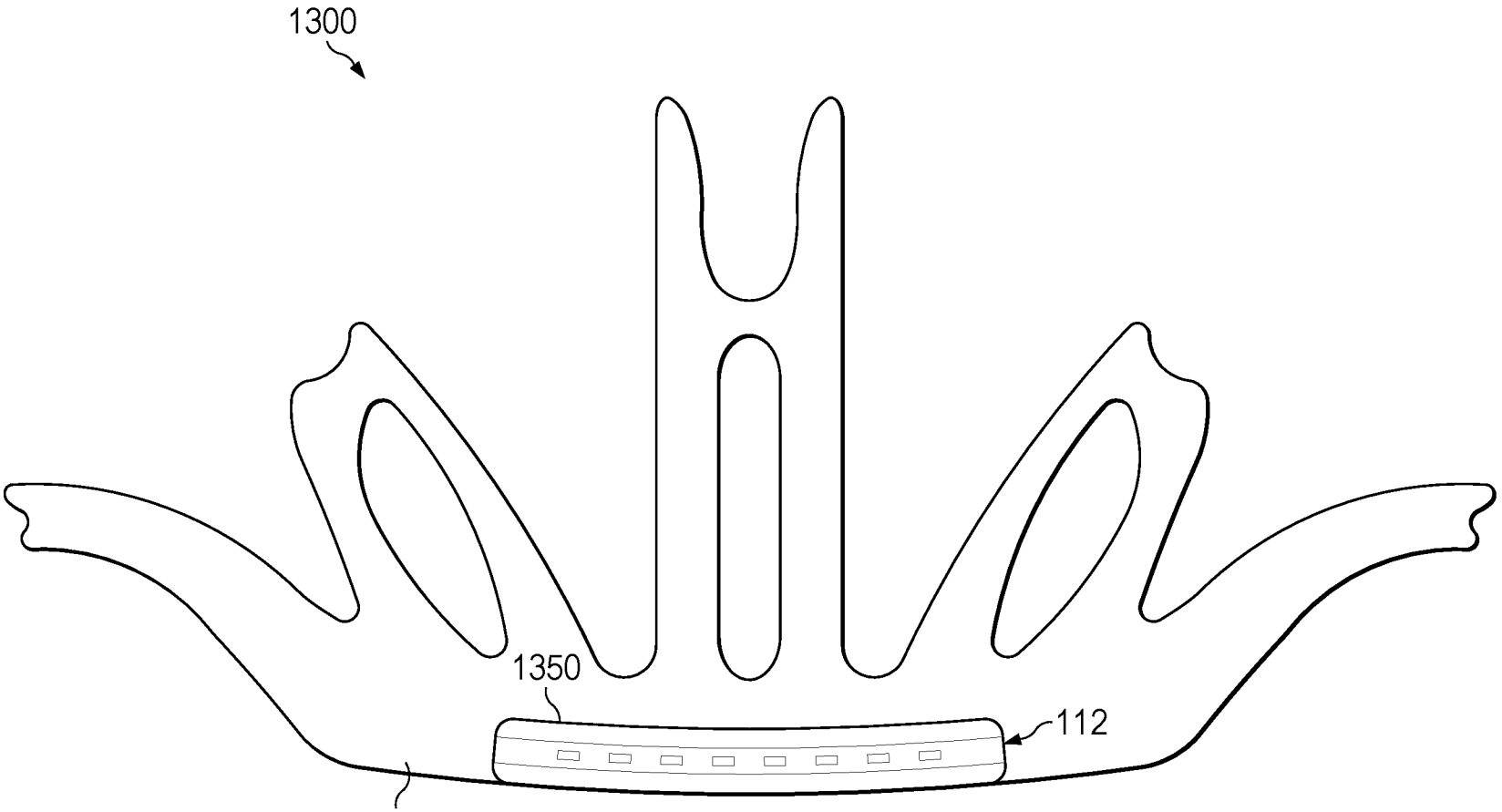
FIG. 13A and 13B are perspective view of a helmet protective pad in which a sweat diverter gutter is integrated according to an embodiment.
Figure 13B:
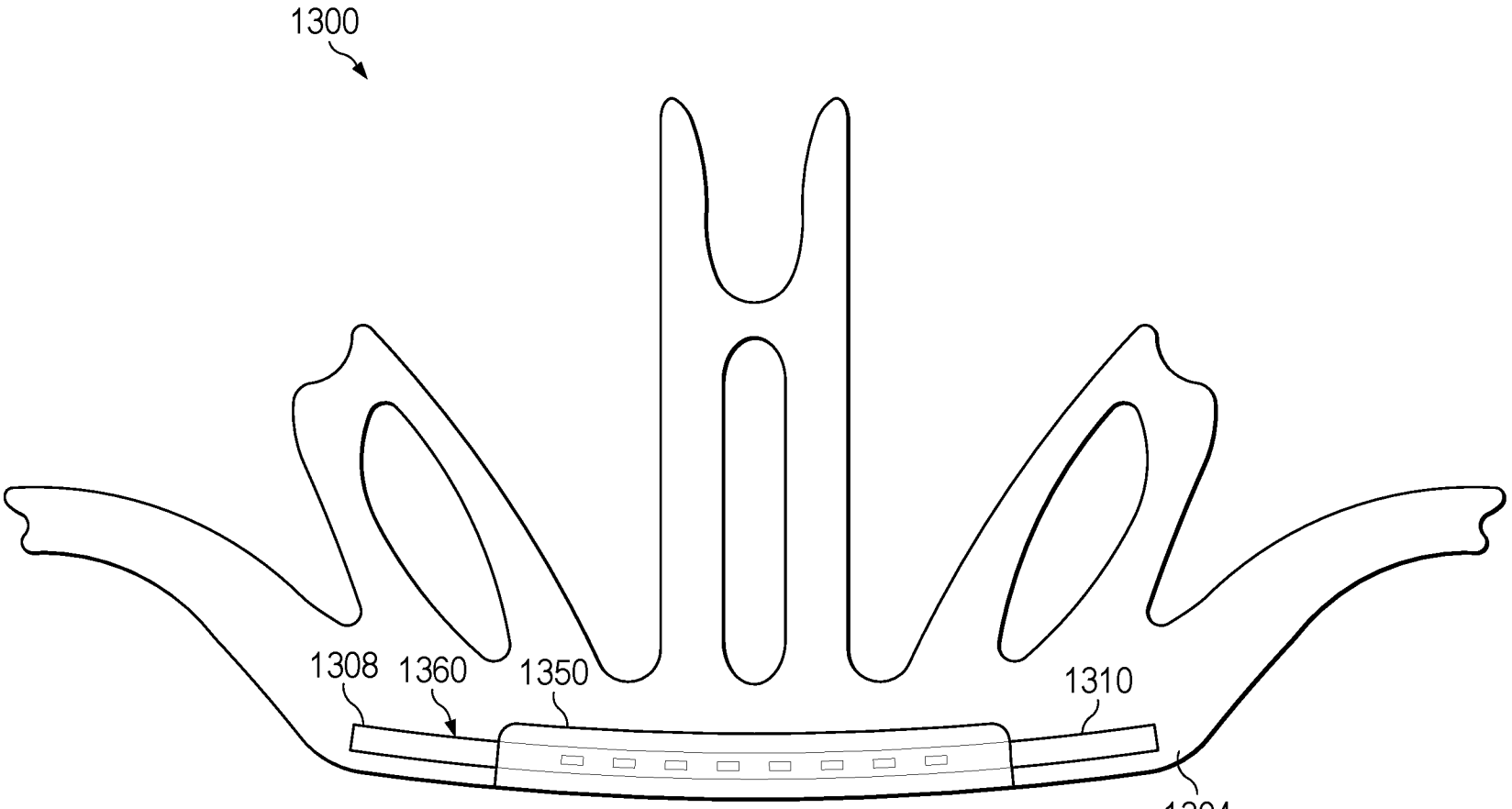

FIGS. 13A and 13B are perspective views of an embodiment of a protective sports helmet pad in which a gutter assembly is integrated. In FIG. 13A, sports helmet pad 1300 is depicted from the interior and in FIG. 13B sports helmet pad 1300 is depicted from the exterior. This type of helmet pad is the type often found in a bicycle safety helmet. Sports helmet pad 1300 is generally of a curved or concave shape to conform to the user's head. Sports helmet pad 1300 includes interior pad side 1302 that would directly contact the wearer's head. As shown, window 1350 is cut from interior pad side 1302, with window 1350 passing through the thickness of sports helmet pad 1300 to the exterior pad side 1304. As shown, gutter subassembly 1360, which comprises lower gutter assembly 112 (shown in interior view), upper gutter assembly 102, left extension 1308 and right extension 1310 (shown in exterior view) is fastened to exterior pad side 1304 in one embodiment by fastening left extension 1308 and right extension 1310 to exterior pad side, with upper gutter section 102, or the "world side" facing away from the user's head. Lower gutter section 112 is shown on the interior pad side 1302 of sports helmet pad 1300 and is directed towards the user's forehead and is the "skin side" of the presently described sweat diverter gutter. Thus, as sports helmet pad 1300 is saturated with sweat, sweat is collected by the substantially u-shaped gutter formed by upper gutter section 102 and lower gutter section 112. In similar fashion as described with respect to previous embodiments, the gutter redirects or diverts sweat to the sides or the users face or head, keeping sweat out of the user's eyes.

Window 1350 in sports helmet pad and gutter subassembly 1360 as shown are disposed close to the lower edge of sports helmet pad 1300. This is but one embodiment and window 1350 and gutter assembly 1360 in other embodiments are situated at different positions vertically (away from the lower edge) along the pad.

Figure 11:
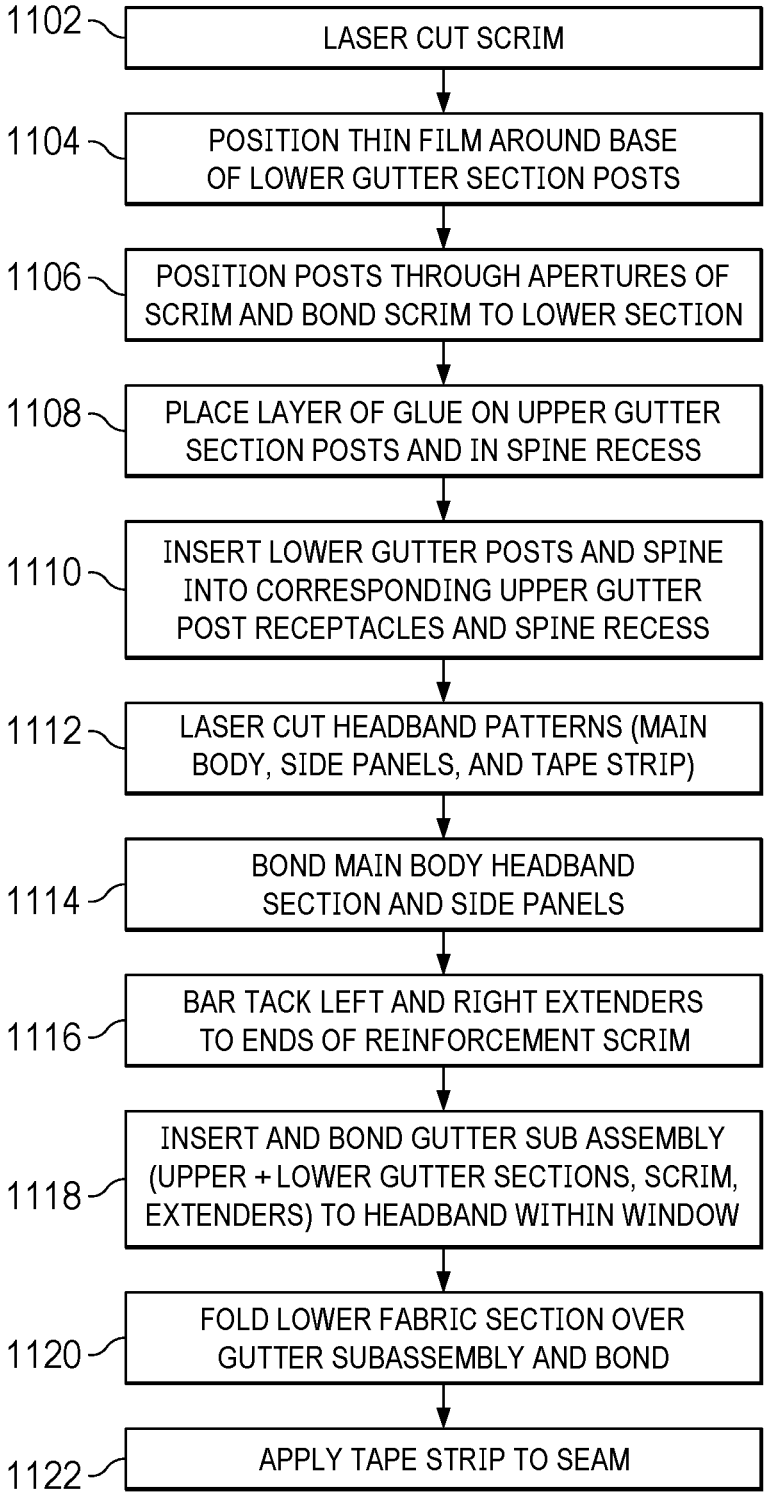
FIG. 11 is a flow diagram of a method of manufacturing a garment with an integrated sweat diverter gutter according to an embodiment.

FIG. 11 is a flow diagram of a method of manufacturing a garment with an integrated sweat diverter gutter according to an embodiment. The various figures discussed above depict components and subcomponents of the presently described sweat diverter gutter as integrated into a headband. The gutter subassembly described is portable in terms of its ability to accommodate hats of various sizes. Integration of a gutter subassembly the same or similar to that described in FIG. 6 into other hats such as wool or synthetic beanies, baseball caps and the like is contemplated. Similarly, an insert or liner for hardhats in which the gutter subassembly is integrated into the liner, thus keeping excess perspiration away from the wearer's eyes is also contemplated. The core components of upper gutter section, lower gutter section and reinforcement scrim, when assembled, are portably adaptable to an endless array of headwear.

The method of manufacturing and integrating the presently described sweat diverter gutter into a headband is described in FIG. 11. FIG. 11 begins with step 1102 where reinforcement scrim is laser cut or cut by other appropriate means. Recall that scrim 200 includes a plurality of apertures 202. Precision sizing of apertures 202 to accommodate posts 116 of lower gutter section 112 is desired to ensure snug and effective placement of scrim 200 between the upper and lower gutter sections, as described. Note that in an alternative embodiment, a reinforcement scrim is not placed between the upper and lower gutter sections. Next at step 1104, an adhesive thin film is placed at the base of lower gutter section 112 around the base of the several posts 116. This allows secure placement of scrim 200 onto and over posts 106 of lower gutter section 112 at step 1106, where posts 106 are inserted through apertures 202 of scrim 200. As a result, scrim 200 is bonded to lower gutter section 112.

Next at step 1108, a layer of adhesive, such as liquid glue, is applied as a coating in post apertures 106 and the spine recess 108 along the length of upper gutter section 102. Then, at step 1110, posts 116 and spine 118 (with scrim 200 already adhered to the base of lower gutter section 112) of lower gutter section 112 are inserted into post receptacles 106 and spine recess 108 of upper gutter section 102. The glue layer promotes a tight and sealed connection of upper gutter section 102 and lower gutter section 112, with the two sections forming a u-shaped trough to collect excess sweat escaping from the saturated headband material.

Next at step 1112 the various parts of the headwear are laser cut. In this example, the main body portion 502 of headband 500 and the side panels 504 and 506 are laser cut, along with tape strip 590 that is later used to finally seal together the integrated gutter subassembly 600 into headband 500. In this pattern cutting process, window 550 is disposed in the lower center of main body portion 502, as depicted in FIG. 5. Then at step 1114, the headband main body part 502 and side sections 504 and 506 are bonded together to form a single piece, as shown in FIG. 6. Note that in another embodiment, side sections 504 and 506 are adhered to the ends of reinforcement scrim 200 before the scrim is placed between upper gutter section 102 and lower gutter section 112.

Continuing the process at step 1116, left extender 508 is bar tacked to one end of scrim 200 at connection point 512 and right extender 510 is bar tacked to the other end of scrim 200, as shown in FIG. 6. This complete gutter subassembly 600, which is comprised of the upper and lower gutter sections, the scrim and two extenders. Gutter subassembly 600 extends substantially the entire width of headband 500. Next at step 1118, gutter subassembly 600 is inserted into the completed headband material with the gutter portions situated within window 550, with the upper edge of gutter subassembly coextensive with the upper edge of window 550. This leaves a slice of window 550 unoccupied along the bottom, to facilitate final assembly as discussed above. The portions of scrim 200 that extend beyond window 550 and extenders 508 and 510 are bonded locally headband body as shown and described in FIG. 7.

Continuing, at step 1120, the fabric lower section 702 of the headband pattern is folded over gutter assembly that was bonded to the headband fabric with the gutter portions remaining in the window. When folding upward and forming a lower edge 800 that is coextensive with the lower edge of gutter subassembly 600, the gutter portions are left exposed on both sides within window 550. At the same time, the upward folding of fabric lower section 702 secures the exterior portions of the scrim and the left and right extenders, which in turn secure the gutter portions in place within window 550, which is critical during use. The upwardly folded fabric lower section is bonded to the adjacent headband fabric. Finally, at step 1122, a tape strip 590 previously cut to size is applied over the seam that spans across the headband that remains when fabric lower section 702 was folded upward. This completes integration of the gutter assembly within the headband material, allowing effective diverting of user sweat away from the eyes once the headband material is saturated with perspiration.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

Additional Disclosure

Clause 1. A sweat diverting apparatus, comprising:

a gutter subassembly comprising:

a lower base portion having at least one connection post;

an upper collection portion having at least one post receptacle sized for receipt of a corresponding at least one connection post;

a reinforcement scrim having a plurality of apertures sized for receipt of the at least one connection post, the reinforcement scrim adhered between the lower base portion and the upper collection portion;

a first elasticized extension fastened to a first end of the reinforcement scrim; and a second elasticized extension fastened to a second end of the reinforcement scrim.

wherein connection of the lower based portion and the upper collection portion form a substantially u-shaped gutter.

Clause 2. The sweat diverting apparatus of any preceding or proceeding clause, wherein the lower base portion and the upper collection portion comprises silicone.

Clause 3. The sweat diverting apparatus of any preceding or proceeding clause, wherein the lower base portion and the upper collection portion comprises thermoplastic elastomer.

Clause 4. The sweat diverting apparatus of any preceding or proceeding clause, wherein the lower base portion and the upper collection portion comprises fluorine rubber.

Clause 5. The sweat diverting apparatus of any preceding or proceeding clause, wherein the reinforcement scrim comprises a manufactured fiber spun from a liquid-crystal polymer.

Clause 6. A sweat diverting textile, comprising:

a gutter subassembly comprising:

a lower base portion having at least one connection post;

an upper substantially c-shaped sweat collection portion having at least one post receptacles sized for receipt of a corresponding the at least one connection post;

a reinforcement scrim having a plurality of apertures sized for receipt of the at least one connection post, the reinforcement scrim adhered between the lower base portion and the upper substantially c-shaped sweat collection portion;

a first elasticized extension fastened to a first end of the reinforcement scrim; and a second elasticized extension fastened to a second end of the reinforcement scrim; and a headwear device comprised of a main fabric body section, having an upper edge and a lower edge and a gutter window disposed within the main fabric body section, wherein connection of the lower based portion and the upper substantially c-shaped sweat collection portion for a substantially u-shaped gutter, wherein a lower portion of the main fabric body section is folded upward to encompass the gutter subassembly, and wherein the folded lower portion of the main fabric section lower edge forms a seam above the gutter subassembly.

Clause 7. The sweat diverting textile of any preceding or proceeding clause, further comprising an adhesive strip to enclose the seam.

Clause 8. The sweat diverting textile of any preceding or proceeding clause, wherein the lower base portion and the upper substantially c-shaped sweat collection portion comprises silicone.

Clause 9. The sweat diverting textile of any preceding or proceeding clause, wherein the lower base portion and the upper substantially c-shaped sweat collection portion comprises thermoplastic elastomer.

Clause 10. The sweat diverting textile of any preceding or proceeding clause, wherein the lower base portion and the upper substantially c-shaped sweat collection portion comprises fluorine rubber.

Clause 11. The sweat diverting textile of any preceding or proceeding clause, wherein the reinforcement scrim comprises a manufactured fiber spun from a liquid-crystal polymer.

Clause 12. The sweat diverting textile of any preceding or proceeding clause, wherein the main fabric body section is made of a different material than the first side fabric section and the second side fabric section.

Clause 13. The sweat diverting textile of any preceding or proceeding clause, wherein the main fabric body section is comprised of a different material than the first side fabric section and the second side fabric section.

Clause 14. The sweat diverting textile of any preceding or proceeding clause, wherein the first side fabric section and the second side fabric section comprise a breathable mesh material.

Clause 15. The sweat diverting textile of any preceding or proceeding clause, wherein the gutter subassembly further comprises:

a spine disposed along the partial length of the lower base portion; and a spine recess disposed along the partial length of the upper collection portion, wherein the spine recess is configured to receive the spine for connecting the lower base portion and the upper collection portion.

Clause 16. A method of manufacturing a sweat diverting textile, comprising the steps of:

cutting a reinforcement scrim and apertures disposed laterally along a partial length of the scrim;

applying a thin film to a gutter lower base portion of a sweat diverting gutter around at least one post disposed laterally along the length of the gutter lower base portion;

inserting the scrim over the at least one post according to the plurality of apertures in alignment with the plurality of posts;

coating at least one post receptacle with an adhesive;

inserting of the at least one post on the lower base portion into a corresponding at least one post receptacle disposed on the upper substantially c-shaped collection portion;

laser cutting parts of a headwear from a material according to a pattern;

assembling the laser cut parts of the headwear;

tacking a first elasticized extension to a first end of the scrim and a second elasticized extension to a second end of the scrim;

align the lower base portion and upper substantially c-shaped sweat collection portion within a window cut from the headwear material;

folding a lower edge of the headwear material over and above the lower base portion and upper substantially c-shaped sweat collection portion within the window; and sealing a seam formed from the folded lower edge of the headwear material with an adhesive strip.

Clause 17. A sweat diverting apparatus, comprising:

an elongated lower base having at least one connection posts;

an upper collection portion having at least one post receptacles;

wherein each of the at least one connection posts are configured for receipt by a corresponding at least one connection posts, wherein the lower base portion and the upper collection portion are configured to form a substantially u-shaped gutter when connected.

Clause 18. The sweat diverting apparatus of any preceding or proceeding clause, further comprising:

a first elasticized extension fastened to a first end of the connected upper collection portion and the lower base portion; and a second elasticized extension fastened to a second end fastened to a first end of the connected upper collection portion and the lower base portion.

Clause 19. The sweat diverting apparatus of any preceding or proceeding clause, further comprising: a reinforcement scrim having a plurality of apertures sized for receipt of the at least one connection posts and corresponding at least one post receptacles when the lower base portion and the upper portion are connected.

Clause 20. The sweat diverting apparatus of any preceding clause, wherein the reinforcement scrim is adhered between the connected lower base portion and the upper collection portion.

What is claimed is:

1. A sweat diverting apparatus, comprising:

a gutter subassembly comprising:

a lower base portion having at least one connection post;

an upper collection portion having at least one post receptacle sized for receipt of a corresponding connection post of the at least one connection post;

a reinforcement scrim having a plurality of apertures sized for receipt of the at least one connection post, the reinforcement scrim adhered between the lower base portion and the upper collection portion;

a first elasticized extension fastened to a first end of the reinforcement scrim; and a second elasticized extension fastened to a second end of the reinforcement scrim;

wherein connection of the lower based portion and the upper collection portion form a substantially u-shaped gutter.

2. The sweat diverting apparatus of claim 1, wherein the lower base portion and the upper collection portion comprise silicone.

3. The sweat diverting apparatus of claim 1, wherein the lower base portion and the upper collection portion comprise thermoplastic elastomer.

4. The sweat diverting apparatus of claim 1, wherein the lower base portion and the upper collection portion comprise fluorine rubber.

5. The sweat diverting apparatus of claim 1, wherein the reinforcement scrim comprises a manufactured fiber spun from a liquid-crystal polymer.

6. A sweat diverting textile, comprising:

a gutter subassembly comprising:

a lower base portion having at least one connection post;

an upper substantially c-shaped sweat collection portion having at least one post receptacles sized for receipt of a corresponding connection post of the at least one connection post;

a reinforcement scrim having a plurality of apertures sized for receipt of the at least one connection post, the reinforcement scrim adhered between the lower base portion and the upper substantially c-shaped sweat collection portion;

a first elasticized extension fastened to a first end of the reinforcement scrim; and a second elasticized extension fastened to a second end of the reinforcement scrim; and a headwear device comprised of a main fabric body section, having an upper edge and a lower edge and a gutter window disposed within the main fabric body section, wherein connection of the lower based portion and the upper substantially c-shaped sweat collection portion form a substantially u-shaped gutter, wherein a lower portion of the main fabric body section is folded upward to encompass the gutter subassembly, and wherein the folded lower portion of the main fabric section lower edge forms a seam above the gutter subassembly.

7. The sweat diverting textile of claim 6, further comprising an adhesive strip to enclose the seam.

8. The sweat diverting textile of claim 6, wherein the lower base portion and the upper substantially c-shaped sweat collection portion comprise silicone.

9. The sweat diverting textile of claim 6, wherein the lower base portion and the upper substantially c-shaped sweat collection portion comprise thermoplastic elastomer.

10. The sweat diverting textile of claim 6, wherein the lower base portion and the upper substantially c-shaped sweat collection portion comprise fluorine rubber.

11. The sweat diverting textile of claim 6, wherein the reinforcement scrim comprises a manufactured fiber spun from a liquid-crystal polymer.

12. The sweat diverting textile of claim 6, wherein the main fabric body section is made of a different material than a first side fabric section and a second side fabric section.

13. The sweat diverting textile of claim 12, wherein the main fabric body section is comprised of a different material than the first side fabric section and the second side fabric section.

14. The sweat diverting textile of claim 13, wherein the first side fabric section and the second side fabric section comprise a breathable mesh material.

15. The sweat diverting textile of claim 6, wherein the gutter subassembly further comprises:

a spine disposed along a partial length of the lower base portion; and a spine recess disposed along a partial length of the upper collection portion, wherein the spine recess is configured to receive the spine for connecting the lower base portion and the upper collection portion.

16. A sweat diverting apparatus, comprising:

an elongated lower base having at least one connection post;

an upper collection portion having at least one post receptacle;

a first elasticized extension fastened to a first end of the connected upper collection portion and the lower base portion;

a second elasticized extension fastened to a second end of the connected upper collection portion and the lower base portion; and a reinforcement scrim having a plurality of apertures sized for receipt of the at least one connection post and corresponding at least one post receptacle when the lower base portion and the upper portion are connected, wherein each of the at least one connection post are configured for receipt by a corresponding connection post of the at least one connection post, wherein the lower base portion and the upper collection portion are configured to form a substantially u-shaped gutter when connected.

17. The sweat diverting apparatus of claim 16, wherein the reinforcement scrim is adhered between the connected lower base portion and the upper collection portion.

18. A method of manufacturing a sweat diverting textile, comprising the steps of:

cutting a reinforcement scrim and a plurality of apertures disposed laterally along a partial length of the scrim;

applying a thin film to a lower base portion of a sweat diverting gutter around at least one post of a plurality of posts disposed laterally along the length of the lower base portion;

inserting the scrim over the at least one post according to the plurality of apertures in alignment with the plurality of posts;

coating at least one post receptacle with an adhesive;

inserting the at least one post on the lower base portion into a corresponding at least one post receptacle disposed on an upper substantially c-shaped collection portion of the sweat diverting gutter;

laser cutting parts of a headwear from a material according to a pattern;

assembling the laser cut parts of the headwear;

tacking a first elasticized extension to a first end of the scrim and a second elasticized extension to a second end of the scrim;

aligning the lower base portion and the upper substantially c-shaped sweat collection portion within a window cut from the headwear material;

folding a lower edge of the headwear material over and above the lower base portion and upper substantially c-shaped sweat collection portion within the window; and sealing a seam formed from the folded lower edge of the headwear material with an adhesive strip.

* * * * *